US009618209B2

(12) United States Patent
Bandaru et al.

(10) Patent No.: US 9,618,209 B2
(45) Date of Patent: Apr. 11, 2017

(54) GAS TURBINE ENGINE FUEL INJECTOR WITH AN INNER HEAT SHIELD

(71) Applicant: SOLAR TURBINES INCORPORATED, San Diego, CA (US)

(72) Inventors: Ramarao Venkat Bandaru, San Diego, CA (US); James Scott Piper, Bonita, CA (US); Scott Michael Lindner, San Diego, CA (US); Anthony Paul Batakis, San Diego, CA (US); Peter Joseph Giella, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 484 days.

(21) Appl. No.: 14/199,419

(22) Filed: Mar. 6, 2014

(65) Prior Publication Data

US 2015/0253009 A1 Sep. 10, 2015

(51) Int. Cl.
*F23R 3/28* (2006.01)
*F23R 3/36* (2006.01)

(52) U.S. Cl.
CPC ..... *F23R 3/28* (2013.01); *F23R 3/36* (2013.01); *F23R 2900/00004* (2013.01)

(58) Field of Classification Search
CPC .... F23R 3/34; F23R 3/343; F23R 3/42; F23R 3/46; F23R 3/14; F23R 3/286; F23R 3/06; F23R 3/20; F23R 3/38; F23R 3/28; F23R 3/36; F23R 2900/00004
USPC ..... 431/12
See application file for complete search history.

(56) References Cited

U.S. PATENT DOCUMENTS

| | | | | |
|---|---|---|---|---|
| 4,311,277 | A * | 1/1982 | Stratton | F23D 17/002 239/400 |
| 4,600,151 | A * | 7/1986 | Bradley | F23D 11/107 239/400 |
| 5,761,907 | A | 6/1998 | Pelletier et al. | |
| 6,276,141 | B1 | 8/2001 | Pelletier | |
| 6,622,488 | B2 | 9/2003 | Mansour et al. | |
| 6,688,534 | B2 * | 2/2004 | Bretz | F23D 11/107 239/135 |
| 7,658,074 | B2 | 2/2010 | Tuttle | |
| 7,779,636 | B2 | 8/2010 | Buelow et al. | |
| 7,926,282 | B2 * | 4/2011 | Chew | F23D 11/107 239/403 |
| 8,015,815 | B2 * | 9/2011 | Pelletier | F23R 3/14 239/132 |
| 8,015,816 | B2 | 9/2011 | Hall | |
| 8,128,007 | B2 * | 3/2012 | Thomson | F23R 3/28 239/405 |

(Continued)

FOREIGN PATENT DOCUMENTS

WO 02073089 A1 9/2002

*Primary Examiner* — David Bryant
*Assistant Examiner* — Lawrence Averick
(74) *Attorney, Agent, or Firm* — Procopio, Cory, Hargreaves & Savitch, LLP

(57) ABSTRACT

A fuel injector for a combustor of a gas turbine engine is disclosed. The fuel injector includes a gas outer tube, a gas inner tube, a liquid tube, and a heat shield. The gas outer tube and the gas inner tube form a gas fuel annulus. The gas inner tube and the liquid tube form a liquid fuel annulus. The liquid tube forms an air cavity. The heat shield extends within the liquid tube forming an insulating gap between the heat shield and the liquid tube.

8 Claims, 4 Drawing Sheets

(56) References Cited

U.S. PATENT DOCUMENTS

| | | | | |
|---|---|---|---|---|
| 8,240,151 | B2 * | 8/2012 | Pelletier | F23D 11/107 60/740 |
| 2002/0134084 | A1 * | 9/2002 | Mansour | F23D 11/107 60/740 |
| 2008/0053062 | A1 | 3/2008 | Tuttle | |
| 2008/0105237 | A1 | 5/2008 | Gandza | |
| 2009/0277176 | A1 * | 11/2009 | Caples | F02C 7/222 60/737 |
| 2010/0307161 | A1 * | 12/2010 | Thomson | F23D 11/107 60/748 |
| 2011/0107764 | A1 * | 5/2011 | Bailey | F01D 25/28 60/737 |
| 2011/0173983 | A1 | 7/2011 | Pinson et al. | |
| 2011/0197589 | A1 | 8/2011 | Khosla et al. | |
| 2014/0090394 | A1 * | 4/2014 | Low | F23R 3/28 60/776 |
| 2014/0291418 | A1 * | 10/2014 | Ruffing | F23R 3/14 239/403 |

* cited by examiner

GAS TURBINE ENGINE FUEL INJECTOR WITH AN INNER HEAT SHIELD

TECHNICAL FIELD

The present disclosure generally pertains to gas turbine engines, and is more particularly directed toward a fuel injector with an inner heat shield.

BACKGROUND

Gas turbine engines include compressor, combustor, and turbine sections. Liquid fuel for gas turbine engines may pyrolyze or coke when heated above certain temperatures. The compressor discharge air may be above these temperatures and may increase the wetted wall of the liquid fuel passage in the fuel injector, which may result in pyrolysis or liquid fuel coking U.S. Pat. No. 7,658,074 to M. Tuttle discloses a fuel nozzle for a gas turbine engine that includes an engine mount end and a discharge end that discharges an air/fuel mixture into a combustion chamber. The fuel nozzle includes a centerbody and a heat shield. The heat shield is fixed to the centerbody at a mid-mount position that is centrally located between first and second ends of the heat shield to allow the heat shield to remain thermally isolated from radially adjacent components to reduce the adverse effects of thermal stresses.

The present disclosure is directed toward overcoming one or more of the problems discovered by the inventors or that is known in the art.

SUMMARY OF THE DISCLOSURE

In one embodiment, a barrel assembly for fuel injector of a combustor for a gas turbine engine is disclosed. The barrel assembly includes a gas outer tube, a gas inner tube, a liquid tube, and a heat shield. The gas outer tube is configured to extend from a gallery portion. The gas outer tube includes an injector cap at an end of the gas outer tube. The injector cap includes an injection opening.

The gas inner tube extends through the gas outer tube to the injector cap forming a gas fuel annulus. The gas inner tube includes a liquid fuel injection opening proximal the injection opening. The liquid tube extends within the gas inner tube forming a liquid fuel annulus there between. The liquid tube includes an air opening adjacent the liquid fuel injection opening.

The heat shield includes a bell mouth portion, a shield cylindrical portion, and a support flange. The bell mouth portion is distal to the air opening. The bell mouth portion includes a funnel shape. The shield cylindrical portion extends from proximal the end of the liquid tube distal to the air opening toward the air opening and within the liquid tube forming an insulating gap between the heat shield and the liquid tube. The support flange extends from the end of the shield cylindrical portion distal to the bell mount portion between the shield cylindrical portion and the liquid inner cylindrical portion.

DETAILED DESCRIPTION

The systems and methods disclosed herein include a fuel injector including a heat shield. In embodiments, the heat shield includes a shield portion extending through a first portion of the liquid tube, forming an air gap there between. The heat shield and the air gap may reduce the wetted wall temperature of the radially inner wall of the liquid tube, which may reduce or prevent the liquid fuel from coking.

Figure 1:
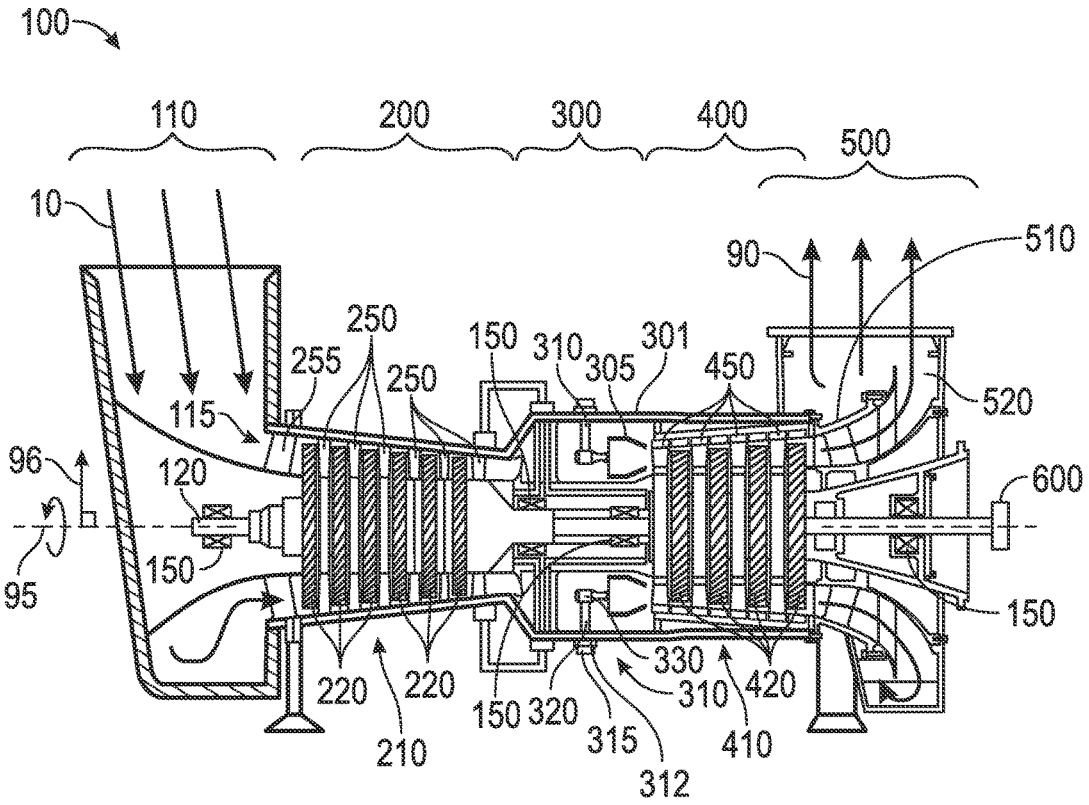
FIG. 1 is a schematic illustration of an exemplary gas turbine engine.

FIG. 1 is a schematic illustration of an exemplary gas turbine engine 100. Some of the surfaces have been left out or exaggerated (here and in other figures) for clarity and ease of explanation. Also, the disclosure may reference a forward and an aft direction. Generally, all references to "forward" and "aft" are associated with the flow direction of primary air (i.e., air used in the combustion process), unless specified otherwise. For example, forward is "upstream" relative to primary air flow, and aft is "downstream" relative to primary air flow.

In addition, the disclosure may generally reference a center axis 95 of rotation of the gas turbine engine, which may be generally defined by the longitudinal axis of its shaft 120 (supported by a plurality of bearing assemblies 150). The center axis 95 may be common to or shared with various other engine concentric components. All references to radial, axial, and circumferential directions and measures refer to center axis 95, unless specified otherwise, and terms such as "inner" and "outer" generally indicate a lesser or greater radial distance from center axis 95, wherein a radial 96 may be in any direction perpendicular and radiating outward from center axis 95.

A gas turbine engine 100 includes an inlet 110, a shaft 120, a compressor 200, a combustor 300, a turbine 400, an exhaust 500, and a power output coupling 600. The gas turbine engine 100 may have a single shaft or a dual shaft configuration.

The compressor 200 includes a compressor rotor assembly 210, compressor stationary vanes (stators) 250, and inlet guide vanes 255. The compressor rotor assembly 210 mechanically couples to shaft 120. As illustrated, the compressor rotor assembly 210 is an axial flow rotor assembly. The compressor rotor assembly 210 includes one or more compressor disk assemblies 220. Each compressor disk assembly 220 includes a compressor rotor disk that is circumferentially populated with compressor rotor blades. Stators 250 axially follow each of the compressor disk assemblies 220. Each compressor disk assembly 220 paired with the adjacent stators 250 that follow the compressor disk assembly 220 is considered a compressor stage. Compressor 200 includes multiple compressor stages. Inlet guide vanes 255 axially precede the compressor stages.

The combustor 300 includes one or more combustion chambers 305, one or more fuel injectors 310, and a combustor case 301 located radially outward from the combustion chamber 305. Each fuel injector 310 includes a barrel assembly 330 adjacent a combustion chamber 305, a flange 312 adjacent the combustor case 301, a fitting boss 315 protruding from the flange 312, and a stem 320 extending from the flange in the direction opposite fitting boss 315, between the fitting boss 315 and the barrel assembly 330.

The turbine 400 includes a turbine rotor assembly 410 and turbine nozzles 450. The turbine rotor assembly 410 mechanically couples to the shaft 120. As illustrated, the turbine rotor assembly 410 is an axial flow rotor assembly. The turbine rotor assembly 410 includes one or more turbine disk assemblies 420. Each turbine disk assembly 420 includes a turbine disk that is circumferentially populated with turbine blades 430. Turbine nozzles 450 axially precede each of the turbine disk assemblies 420. Each turbine disk assembly 420 paired with the adjacent turbine nozzles 450 that precede the turbine disk assembly 420 is considered a turbine stage. Turbine 400 includes multiple turbine stages.

The exhaust 500 includes an exhaust diffuser 510 and an exhaust collector 520. The power output coupling 600 may be located at an end of shaft 120.

Figure 2:
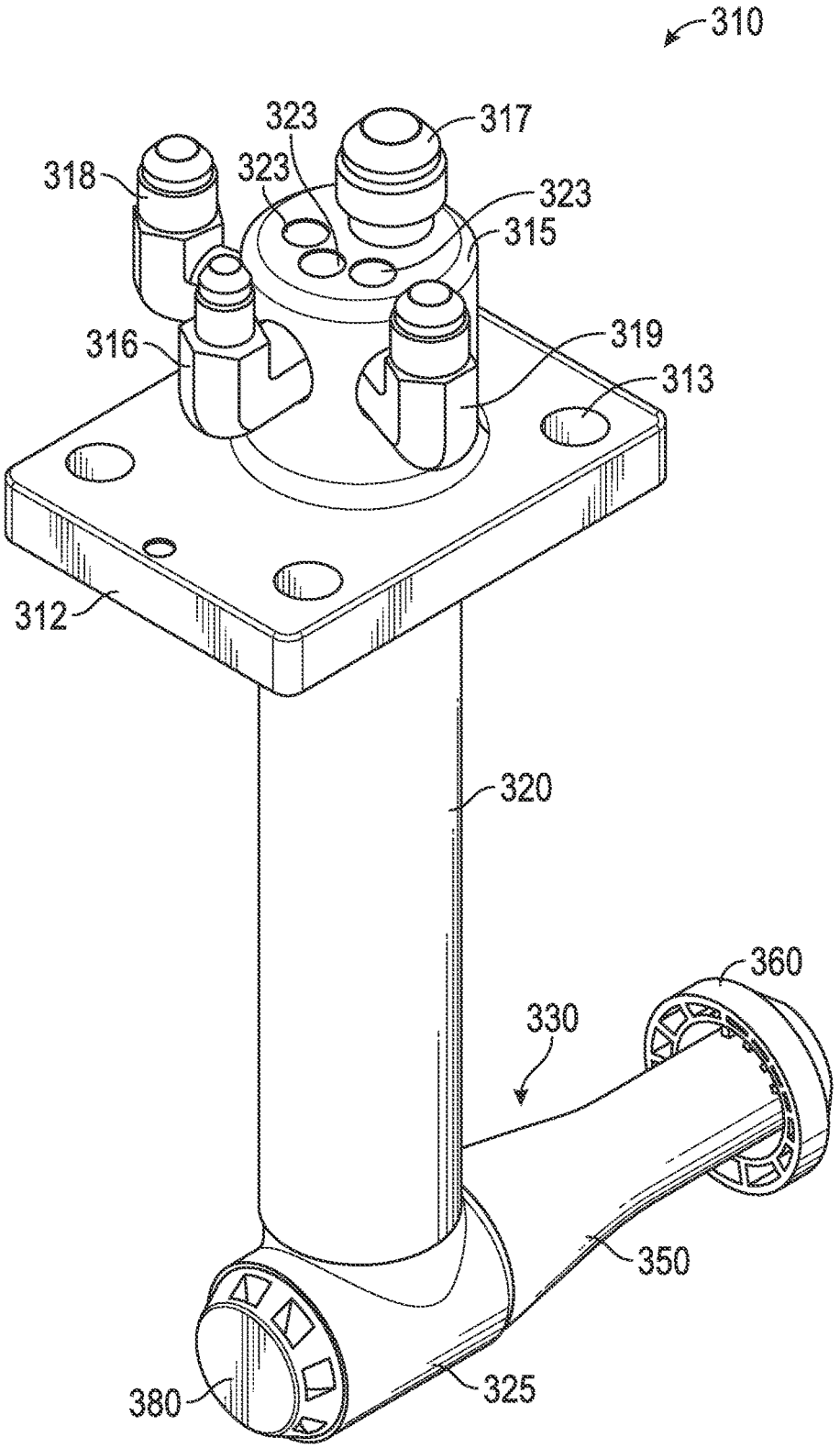
FIG. 2 is a perspective view of a fuel injector for the combustor of FIG. 1.

FIG. 2 is a perspective view of a fuel injector 310 for the combustor 300 of FIG. 1. Referring to FIG. 2, fitting boss 315, flange 312, and stem 320 may be an integral piece. Fitting boss 315 may include a cylindrical or prism shape extending from flange 312. Multiple fittings may be coupled to fitting boss 315. Liquid fuel, gas fuel, and air supply lines may be coupled to the fittings to supply liquid fuel, gas fuel, and air to the fuel injector 310. In the embodiment illustrated in FIG. 2, a liquid fuel fitting 316 is coupled to the side of fitting boss 315 and a gas fuel fitting 317 is coupled to the top surface of fitting boss 315. In the embodiment shown, fittings 318 and 319 are also coupled to the side of fitting boss 315. Fittings 318 and 319 may be used for liquid or gas pilot fuel supply or may be used to supply air.

Flange 312 may include a circular or polygonal shape. In the embodiment shown in FIG. 2, flange 312 includes a rectangular shape. Flange 312 includes multiple mounting holes 313. Mounting holes 313 may be used to affix fuel injector 310 to combustor case 301.

Figure 3:
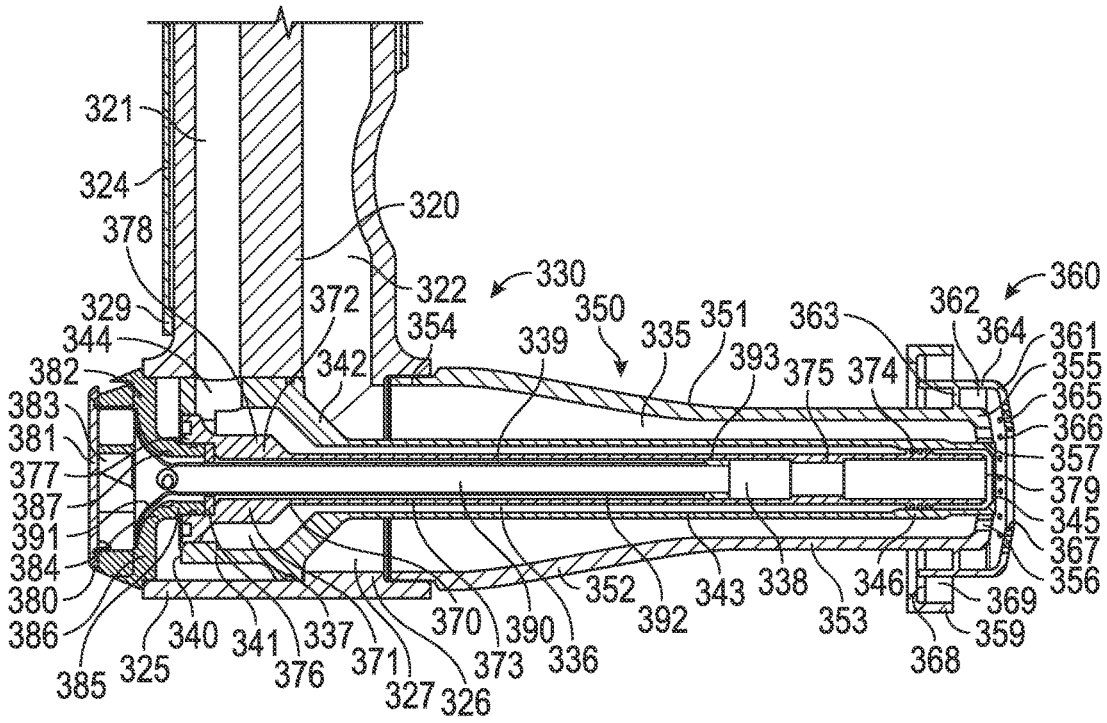
FIG. 3 is a cross-section of a portion of the fuel injector of FIG. 2.

FIG. 3 is a cross-section of a portion of the fuel injector 310 of FIG. 2. Referring to FIGS. 2 and 3, fuel injector 310 may include a gallery portion 325. Gallery portion 325 may include a hollow cylinder shape and may be located at an end of stem 320, opposite and distal to flange 312. Gallery portion 325 may be an integral piece and may be machined or molded with fitting boss 315, flange 312, and stem 320.

Stem 320 may include a stem heat shield 324. Stem heat shield 324 may include a hollow cylinder shape and may include at stem heat shield support flange 329 extending radially inward from the hollow cylinder shape at each end of the stem heat shield 324 adjacent the flange 312 and the gallery portion 325. The stem heat shield support flanges 329 may act as a stand-off or spacer forming a stem insulating gap 328, an annular space between stem 320 and stem heat shield 324.

Fuel injector 310 includes multiple passages extending from fitting boss 315 to gallery portion 325. Each passage may be machined or drilled from the top of fitting boss 315 to the gallery portion 325. A fitting, such as gas fuel fitting 317 or a cap 323 may be placed or inserted at the end of each passage at fitting boss 315. As illustrated in FIG. 3, fuel injector 310 includes a liquid fuel passage 321 and a gas fuel passage 322. Liquid fuel passage 321 is fluidly coupled to liquid fuel fitting 316 and gas fuel passage 322 is fluidly coupled to gas fuel fitting 317. Other passages, such as those shown capped in FIG. 2, may fluidly couple to fittings 318 and 319. These passages may supply liquid and gas pilot fuel or air to the barrel assembly 330.

Referring to FIG. 3, barrel assembly 330 and gallery portion 325 may share a common axis 331. All references to radial, axial, and circumferential directions and measures relating to barrel assembly 330 and gallery portion 325 refer to axis 331 and terms such as "inner" and "outer" generally indicate a lesser or greater radial distance from axis 331. Gallery portion 325 may revolve about axis 331.

Barrel assembly 330 may include swirler assembly 350, gas inner tube 340, liquid tube 370, inlet swirler 380, and heat shield 390. Swirler assembly 350 may be a single integral piece or may be multiple pieces metalurgically bonded together, such as by brazing or welding. Swirler assembly 350 may include gas outer tube 351 and outlet swirler 360. Gas outer tube 351 may extend from gallery portion 325. Gas outer tube 351 and gallery portion 325 may be metalurgically bonded, such as brazed or welded. Gas outer tube 351 may include tapered region 352, cylindrical region 353, and injector cap 355. Tapered region 352 may extend axially from gallery portion 325.

Tapered region 352 may taper from the end adjacent lip 354 from a larger diameter to a smaller diameter adjacent cylindrical region 353. Tapered region 352 may include the shape of a funnel or a frustum of a hollow cone. The smaller diameter of tapered region 352 may match the diameter of cylindrical region 353. Tapered region 352 may include lip 354. Lip 354 may extend the end of the funnel with the larger diameter and may be sized to fit into and mate with an end of gallery portion 325.

Cylindrical region 353 extends axially from tapered region 352 in the direction opposite gallery portion 325 and lip 354. Cylindrical region 353 may include a constant diameter and may be the shape of a hollow right circular cylinder. Injector cap 355 may be located at the end of gas outer tube 351, such as at the end of cylindrical region 353 opposite and distal to tapered region 352, and may be located distal to gallery portion 325. Injector cap 355 may extend radially inward from the end of the cylindrical region 353 distal to tapered region 352. Injector cap 355 may include an injection opening 357 and gas fuel injection holes 356. The injector opening may be a circular shape that is coaxial to axis 331. Gas fuel injection holes 356 may be circumferentially spaced about injector cap 355 located radially outward from injection opening 357.

Outlet swirler 360 may include outlet shroud 361 and shroud swirler vanes 362. Outlet shroud 361 may include shroud cylindrical portion 364 and shroud cap 365. Shroud cylindrical portion 364 is located radially outward from cylindrical region 353 at the end adjacent injector cap 355. Shroud cylindrical portion 364 may include a hollow cylinder shape. Shroud cap 365 is located at an end of shroud cylindrical portion 364 and is adjacent injector cap 355. Shroud cap 365 may include shroud injection opening 367 and shroud injection holes 366. Shroud injection opening 367 may also be a circular shape coaxial to axis 331 and may include a diameter larger than the diameter of injection opening 357. Shroud injection holes 366 may be circumferentially spaced apart about shroud cap 365 located radially outward from shroud injection opening 367.

Shroud swirler vanes 362 may extend between shroud cylindrical portion 364 and cylindrical region 353. Shroud swirler vanes 362 may connect shroud cylindrical portion 364 and cylindrical region 353 together and may support outlet swirler 360. Shroud swirler vanes 362 may be angled and configured to circumferentially deflect compressor discharge air passing between shroud cylindrical portion 364 and cylindrical region 353.

Outlet swirler 360 may also include secondary shroud 368 and secondary swirler vanes 369. Secondary shroud 368 may be located radially outward from shroud cylindrical portion 364 adjacent the end distal to or opposite shroud cap 365. Secondary shroud 368 may include a hollow cylinder shape. Secondary swirler vanes 369 extend between secondary shroud 368 and shroud cylindrical portion 364. Secondary swirler vanes 369 are also angled and configured to circumferentially deflect compressor discharge air.

Gas inner tube 340 includes intermediate gallery portion 341, transition portion 342, and gas inner cylindrical portion 343. Intermediate gallery portion 341, transition portion 342, and gas inner cylindrical portion 343 may each be coaxial to axis 331. Intermediate gallery portion 341 may be located within gallery portion 325 and may be located radially inward from gallery portion 325. Intermediate gallery portion 341 may include a hollow cylinder shape. Intermediate gallery portion 341 may also include a first protrusion 347, a second protrusion 348, and a liquid fuel inlet 344. The first protrusion 347 may extend from the hollow cylinder shape and interface with the stem 320. The second protrusion 348 may extend radially from the hollow cylinder shape and may be located at or adjacent to transition portion 342. The second protrusion 348 may contact gallery portion 325 and may hold gas inner tube 340 in place. The second protrusion 348 may also contact gallery protrusion 326 to locate intermediate gallery portion 341 within gallery portion 325.

Liquid fuel inlet 344 aligns with and is in fluid communication with liquid fuel passage 321. Liquid fuel inlet 344 may extend through the hollow cylinder shape of intermediate gallery portion 341 and first protrusion 347. First protrusion 347 may interface with and may form a seal with stem 320 at the communication point of liquid fuel inlet 344 and liquid fuel passage 321.

Transition portion 342 extends from intermediate gallery portion 341 and is located between intermediate gallery portion 341 and gas inner cylindrical portion 343 within gallery portion 325. Transition portion 342 may extend in the axial direction and may be located radially inward from gallery portion 325. Transition portion 342 is configured to reduce the diameter of gas inner tube 340 from intermediate gallery portion 341 and gas inner cylindrical portion 343. Transition portion 342 may include the shape of a funnel, such as the frustum of a hollow cone (a hollow frustoconical shape) with the larger diameter located at the intermediate gallery portion 341 and the smaller diameter located at the gas inner cylindrical portion 343. Transition portion 342 and gallery portion 325 may be configured to form a gas gallery 327 adjacent and in fluid communication with gas fuel passage 322.

Gas inner cylindrical portion 343 extends from the end of transition portion 342 with the smaller diameter, distal to where intermediate gallery portion 341 extends from transition portion 342. Gas inner cylindrical portion 343 may extend in the axial direction. Gas inner cylindrical portion 343 includes a hollow cylinder shape and extends through gas outer tube 351 to injector cap 355 forming a gas fuel annulus 335 there between. Gas inner cylindrical portion 343 may be located radially inward from gas outer tube 351. Gas inner cylindrical portion 343 may include liquid fuel tapered portion 346. Liquid fuel tapered portion 346 may be configured to reduce the inner diameter of gas inner cylindrical portion 343 proximal or near a liquid fuel injection opening 345. The liquid fuel injection opening 345 may be located proximal to injection opening 357, radially inward from injection opening 357, and distal to transition portion 342 at an end of gas inner cylindrical portion 343.

Liquid tube 370 may be located within gas inner tube 340 and may be located radially inward from gas inner tube 340. Liquid tube 370 includes inner gallery portion 371, inner transition portion 372, and liquid inner cylindrical portion 373. Inner gallery portion 371, inner transition portion 372, and liquid inner cylindrical portion 373 may each be coaxial to axis 331. Inner gallery portion 371 may be located within intermediate gallery portion 341 and may be radially inward from intermediate gallery portion 341. Inner gallery portion 371 and intermediate gallery portion 341 may form liquid gallery 337 there between. The liquid gallery 337 being in flow communication with liquid fuel inlet 344 and the liquid fuel passage 321. Inner gallery portion 371 may include an end portion 377 and an inner gallery cylindrical portion 378. End portion 377 may be a solid of revolution with the two dimensional shape defining the solid of revolution spaced apart from its axis of revolution and revolved about its axis of revolution forming swirler counter-bore 376. The solid of revolution may be a cylinder combined with a frustum of a cone with a bore extending there through. End portion 377 may be at the end of liquid tube 370, radially inward from the end of liquid tube 370, and may contact and interface with the end of intermediate gallery portion 341 distal to transition portion 342 to form a seal. End portion 377 may be configured to redirect liquid fuel from a radial direction to an axial direction. Inner gallery cylindrical portion 378 may extend axially from end portion 377 with a hollow cylinder shape. The inner radius of inner gallery cylindrical portion 378 may be smaller than the inner radius of end portion 377. The proximal end of inner gallery cylindrical portion 378 may form the radial surface of swirler counter-bore 376. Swirler counter-bore 376 may be a counter-bore in inner gallery portion 371 configured to interface with inlet swirler 380.

Inner transition portion 372 may be a frustoconical shape with a bore extending there through. Inner transition portion 372 may extend from inner gallery portion 371 and may be located axially between inner gallery portion 371 and liquid inner cylindrical portion 373. The outer diameter of inner transition portion 372 reduces from inner gallery portion 371 to liquid inner cylindrical portion 373.

Liquid inner cylindrical portion 373 may extend from inner transition portion 372 and may extend in the axial direction. Liquid inner cylindrical portion 373 may extend within gas inner cylindrical portion 343 forming a liquid fuel annulus 336 there between and may be located radially inward from gas inner cylindrical portion 343. The liquid fuel annulus 336 may be in fluid communication with liquid gallery 337. Liquid inner cylindrical portion 373 includes an air opening 379. Air opening 379 is located distal to inner transition portion 372 and adjacent to liquid fuel injection opening 345.

Inner gallery portion 371, inner transition portion 372, and liquid inner cylindrical portion 373 form air cavity 338 extending through liquid tube 370. Air cavity 338 may be coaxial to axis 331.

Liquid tube 370 may also include liquid fuel swirler vanes 374 and containment portion 375. Liquid fuel swirler vanes 374 may extend radially outward from liquid inner cylindrical portion 373 and may axially align with and contact liquid fuel tapered portion 346. Containment portion 375 may be a protrusion extending radially inward from liquid inner cylindrical portion 373. Containment portion 375 may include a hollow cylinder shape with an inner diameter smaller than the inner diameter of liquid inner cylindrical portion 373. In one embodiment, containment portion 375 is located within one-third of the length of liquid tube 370 from air opening 379. In another embodiment containment portion 375 is located within one-fourth of the length of liquid tube 370 from air opening 379. In yet another embodiment, containment portion 375 is located at approximately one-fourth of the length of liquid tube 370. In yet a further embodiment, containment portion 375 is located adjacent air opening 379 at the end of liquid tube 370. Containment portion 375 may be an integral piece to the remainder of liquid tube 370, such as integral to liquid inner cylindrical portion 373 and may be machined as part of liquid inner cylindrical portion 373.

Inlet swirler 380 may include inlet cap 381, base portion 382, and inlet swirler vanes 383. Inlet cap 381 may include a disk shape and may be coaxial to axis 331. Base portion 382 may also be coaxial to axis 331. Base portion 382 may include disk portion 386, swirler stem 385, and bell portion 384. Disk portion 386 is spaced apart from inlet cap 381. Disk portion 386 may be partially insert into the end of gallery portion 325 distal to swirler assembly 350 with part of disk portion 386 inserting into the end of the hollow cylinder shape of gallery portion 325. Disk portion 386 may include an annular disk shape. Swirler stem 385 may include a hollow cylinder shape coaxial to axis 331. Swirler stem 385 is spaced apart from disk portion 386 and may be configured to partially insert into swirler counter-bore 376.

Bell portion 384 may extend from disk portion 386 to swirler stem 385. Bell portion 384 may extend from the inner radius of the annular shape of disk portion 386 and may curve or transition from the annular disk shape of disk portion 386 into the hollow cylinder shape of swirler stem 385. The shape of bell portion 384 may include a funnel shape, such as a hyperbolic funnel, bell, or segment or frustum of a pseudosphere.

Inlet swirler vanes 383 extend between inlet cap 381 and disk portion 386. Inlet swirler vanes 383 may be angled and configured to swirl and direct compressor discharge air into air cavity 338. Inlet swirler 380 may include stem holes 387. Stem holes 387 may extend radially through swirler stem 385 and may be located at or adjacent bell portion 384. Inlet swirler 380 may include one or more stem holes 387. In the embodiment illustrated, inlet swirler 380 includes four stem holes 387.

Heat shield 390 includes a bell mouth portion 391, a shield cylindrical portion 392, and support flange 393. Bell mouth portion 391, shield cylindrical portion 392, and support flange 393 may be coaxial to axis 331. Bell mouth portion 391 may include the shape of a funnel, such as a hyperbolic funnel, bell, or segment or frustum of a pseudosphere. Bell mouth portion 391 is configured to be inserted and fit within bell portion 384.

Shield cylindrical portion 392 may extend from proximal the end of liquid tube 370 distal to air opening 379 toward air opening 379, within liquid inner cylindrical portion 373, and may be located radially inward from liquid inner cylindrical portion 373 forming an insulating gap 339 there between. Insulating gap 339 may be an annular space between heat shield 390 and liquid tube 370. In one embodiment, heat shield 390 extends within liquid tube 370 up to three quarters of the length of the length of liquid tube 370. In another embodiment, heat shield 390 extends within liquid tube 370 from one half to three quarters of the length of liquid tube 370. In yet another embodiment, heat shield 390 extends within liquid tube 370 up to two thirds of the length of liquid tube 370. In yet a further embodiment, heat shield 390 extends within liquid tube 370 at least on half of the length of liquid tube 370. In any of the embodiments including containment portion 375, containment portion 375 is located closer to air opening 379 than the end of shield cylindrical portion 392 distal to bell mouth portion 391 and heat shield 390 may extend to containment portion 375. In the embodiment illustrated in FIG. 3, shield cylindrical portion 392 extends from bell mouth portion 391. Shield cylindrical portion 392 may extend in the axial direction.

Heat shield 390 includes at least one support flange 393. Each support flange 393 extends between shield cylindrical portion 392 and liquid inner cylindrical portion 373. Each support flange 393 may be a flange with a hollow cylinder shape. The embodiment in FIG. 3 includes one support flange 393 extending radially outward from the end of shield cylindrical portion 392 distal to bell mouth portion 391 and between shield cylindrical portion 392 and liquid inner cylindrical portion 373. In other embodiments, multiple support flanges 393 may extend radially outward from shield cylindrical portion 392 and may be evenly spaced apart along shield cylindrical portion 392. One or more support flanges 393 may be located radially between shield cylindrical portion 392 and liquid inner cylindrical portion 373, and axially between bell mouth portion 391 and the support flange 393 extending radially outward from the end of shield cylindrical portion 392. The spacing of support flanges 393 may be configured to account for thermal expansion for heat shield 390 and liquid tube 370.

Containment portion 375 may be radially aligned with shield cylindrical portion 392 and/or support flange(s) 393. Containment portion 375 may be configured to prevent a broken off piece of shield cylindrical portion 392 or of a support flange 393 from exiting fuel injector 310 and entering combustion chamber 305.

Figure 4:
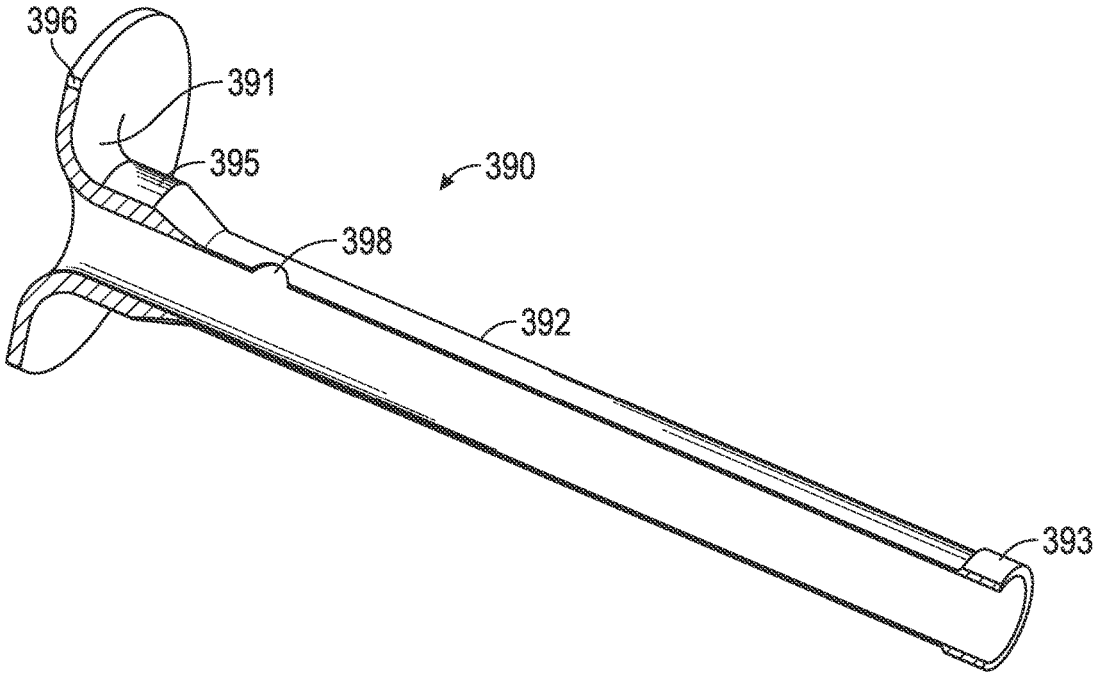
FIG. 4 is a cutaway view of an alternate embodiment of the heat shield of FIG. 3.

FIG. 4 is a cutaway view of an alternate embodiment of the heat shield 390 of FIG. 3. Referring to FIG. 4, heat shield 390 may include a thickened portion 395. In the embodiment illustrated in FIG. 4, thickened portion 395 extends from bell mouth portion 391. Thickened portion 395 may extend in the axial direction. Thickened portion 395 may include a radially thicker hollow cylinder than that of shield cylindrical portion 392. The outer surface of thickened portion 395 may taper into shield cylindrical portion 392. In this embodiment, shield cylindrical portion 392 extends from thickened portion 395.

Bell mouth portion 391 may include an alignment feature 396 for aiding in aligning and installing heat shield 390 within liquid tube 370 and inlet swirler 380. Heat shield 390 may also include a shield hole 398.

The various components and sub-components of each fuel injector 310, such as gallery portion 325, swirler assembly 350, gas inner tube 340, liquid tube 370, inlet swirler 380, and heat shield 390 may be connected by a press or interference fit, or may be metalurgically bonded. The metallurgical bonding may include welding or brazing.

One or more of the above components (or their subcomponents) may be made from stainless steel and/or durable, high temperature materials known as "superalloys". A superalloy, or high-performance alloy, is an alloy that exhibits excellent mechanical strength and creep resistance at high temperatures, good surface stability, and corrosion and oxidation resistance. Superalloys may include materials such as HASTELLOY, alloy x, INCONEL, WASPALOY, RENE alloys, HAYNES alloys, alloy 188, alloy 230, INCOLOY, MP98T, TMS alloys, and CMSX single crystal alloys.

INDUSTRIAL APPLICABILITY

Gas turbine engines may be suited for any number of industrial applications such as various aspects of the oil and gas industry (including transmission, gathering, storage, withdrawal, and lifting of oil and natural gas), the power generation industry, cogeneration, aerospace, and other transportation industries.

Referring to FIG. 1, a gas (typically air 10) enters the inlet 110 as a "working fluid", and is compressed by the compressor 200. In the compressor 200, the working fluid is compressed in an annular flow path 115 by the series of compressor disk assemblies 220. In particular, the air 10 is compressed in numbered "stages", the stages being associated with each compressor disk assembly 220. For example, "4th stage air" may be associated with the 4th compressor disk assembly 220 in the downstream or "aft" direction, going from the inlet 110 towards the exhaust 500). Likewise, each turbine disk assembly 420 may be associated with a numbered stage.

Once compressed air 10 leaves the compressor 200, it enters the combustor 300, where it is diffused and fuel is added. Air 10 and fuel are injected into the combustion chamber 305 via fuel injector 310 and combusted. Energy is extracted from the combustion reaction via the turbine 400 by each stage of the series of turbine disk assemblies 420. Exhaust gas 90 may then be diffused in exhaust diffuser 510, collected and redirected. Exhaust gas 90 exits the system via an exhaust collector 520 and may be further processed (e.g., to reduce harmful emissions, and/or to recover heat from the exhaust gas 90).

Gas turbine engine 100 may be configured to operate on multiple types of fuels. Referring to FIGS. 2 and 3, fuel injector 310 may be a dual fuel injector allowing for operation on gas fuels or liquid fuels. When operating on a gas fuel, the gas fuel is supplied to the gas fuel passage 322 via gas fuel fitting 317. The gas fuel is directed into gas gallery 327 where the gas fuel is directed axially, relative to axis 331, into and through gas fuel annulus 335. The gas fuel exits gas fuel annulus 335 through gas fuel injection holes 356. As the gas fuel exits gas fuel injection holes 356, the gas fuel is mixed with compressor discharge air passing through air cavity 338 and through outlet swirler 360 and then combusted in the combustion chamber 305.

When operating on a liquid fuel, the liquid fuel is supplied to the liquid fuel passage 321 via liquid fuel fitting 316. The liquid fuel is directed through liquid fuel inlet 344 and into liquid gallery 337 where the liquid fuel is directed axially, relative to axis 331, into and through liquid fuel annulus 336. The liquid fuel may be swirled or redirected circumferentially by liquid fuel swirler vanes 374 prior to exiting liquid fuel annulus 336. During liquid fuel operation, air may be directed through gas fuel passage 322, gas gallery 327, and gas fuel annulus 335, which may be mixed with the liquid fuel as the air exits gas fuel annulus 335. The air directed through gas fuel passage 322, gas gallery 327, and gas fuel annulus 335 may be slightly cooler than compressor discharge air.

During both gas fuel operation and liquid fuel operation compressor discharge air is directed into inlet swirler 380 and through air cavity 338. The swirled compressor discharge air exits air cavity 338 and mixes with either the liquid fuel or the gas fuel prior to combustion.

Liquid fuel may pyrolzye when subjected to high temperatures. The temperature of compressor discharge air may be greater than the pyrolysis (often referred to as liquid fuel coking) temperature. The swirling compressor discharge air may travel through air cavity 338 at relatively high velocities and may increase the temperature of the liquid tube 370 and in particular the liquid wetted wall temperature of the liquid tube 370 above the pyrolysis temperature, which may lead to pyrolysis or coking of the liquid fuel, and a buildup of carbon/coke deposits in liquid fuel annulus 336. The buildup may block the liquid fuel annulus 336 leading to operability problems and shutdown of the gas turbine engine 100.

Heat shield 390 extending within liquid tube 370 forms an insulating gap 339 between liquid tube 370 and heat shield 390. Insulating gap 339 may insulate and may reduce the amount of heat transferred from the swirled compressor discharge air to the liquid wetted wall. The reduction in heat transferred may reduce the temperature of the liquid wetted wall to a temperature below the pyrolysis temperature and may prevent or reduce liquid fuel coking.

Heat shield 390 extending within liquid tube 370 less than the full length of liquid tube 370 may provide the reduction of heat transfer needed, while limiting the amount of material required for the heat shield 390.

Over time heat shield 390 may degrade. This degradation may cause a portion of heat shield to break loose. Such failure may damage downstream components such as combustion chamber 305. Containment portion 375 projects radially inward from liquid inner cylindrical portion 373 and radially aligns with portions of heat shield 390 that may break away, such as shield cylindrical portion 392 and support flange 393. The radially alignment of containment portion 375 with shield cylindrical portion 392 and support flange(s) 393 may block any loose piece of heat shield 390 from passing beyond containment portion 375 and may prevent damage to downstream components.

The preceding detailed description is merely exemplary in nature and is not intended to limit the invention or the application and uses of the invention. The described embodiments are not limited to use in conjunction with a particular type of gas turbine engine. Hence, although the present disclosure, for convenience of explanation, depicts and describes a particular fuel injector, it will be appreciated that the fuel injector in accordance with this disclosure can be implemented in various other configurations, can be used with various other types of gas turbine engines, and can be used in other types of machines. Furthermore, there is no intention to be bound by any theory presented in the preceding background or detailed description. It is also understood that the illustrations may include exaggerated dimensions to better illustrate the referenced items shown, and are not consider limiting unless expressly stated as such.

What is claimed is:

1. A barrel assembly for a fuel injector of a combustor for a gas turbine engine, the barrel assembly comprising:

a gas outer tube configured to extend from a gallery portion, the gas outer tube including an injector cap at an end of the gas outer tube, the injector cap including an injection opening;

a gas inner tube extending through the gas outer tube to the injector cap forming a gas fuel annulus, the gas inner tube including a liquid fuel injection opening proximal the injection opening;

a liquid tube extending within the gas inner tube forming a liquid fuel annulus there between, the liquid tube including an air opening adjacent the liquid fuel injection opening; and a heat shield including a bell mouth portion distal to the air opening, the bell mouth portion including a funnel shape, a shield cylindrical portion extending from proximal the end of the liquid tube distal to the air opening toward the air opening and within the liquid tube forming an insulating gap between the heat shield and the liquid tube, and a support flange extending from the end of the shield cylindrical portion distal to the bell mouth portion between the shield cylindrical portion and the liquid tube.

2. The barrel assembly of claim 1, wherein the shield cylindrical portion extends from the bell mouth portion.

3. The barrel assembly of claim 1, wherein the heat shield further includes a thickened portion extending from the bell mouth portion, the thickened portion including a hollow cylinder shape that is thicker than the shield cylindrical portion, and the shield cylindrical portion extending from the thickened portion.

4. The barrel assembly of claim 1, wherein the shield cylindrical portion extends within the liquid tube up to three quarters of the length of the liquid tube.

5. The barrel assembly of claim 4, wherein the shield cylindrical portion extends within the liquid tube at least one half of the length of the liquid tube.

6. The barrel assembly of claim 1, wherein the liquid tube further includes a liquid inner cylindrical portion extending within the gas inner tube with a hollow cylinder shape, and a containment portion protruding inward from the liquid inner cylindrical portion, the containment portion being axially closer to the air opening than the end of shield cylindrical portion distal to the bell mouth portion.

7. The barrel assembly of claim 6, wherein the containment portion is located within one third of the length of the liquid tube from the air opening.

8. The barrel assembly of claim 6, wherein the containment portion is an integral piece to the liquid inner cylindrical portion.

* * * * *